United States Patent [19]

Yates, Jr.

[11] Patent Number: 4,829,901

[45] Date of Patent: May 16, 1989

[54] SHAPED CHARGE HAVING MULTI-POINT INITIATION FOR WELL PERFORATING GUNS AND METHOD

[75] Inventor: Donald N. Yates, Jr., The Woodlands, Tex.

[73] Assignee: Baker Hughes Incorporated, Houston, Tex.

[21] Appl. No.: 138,389

[22] Filed: Dec. 28, 1987

[51] Int. Cl.[4] ..... F42B 1/02; F42B 3/08

[52] U.S. Cl. ..... 102/306; 89/1.15; 102/309; 175/4.6

[58] Field of Search ..... 89/1.15; 102/306, 307, 102/309, 310, 701; 175/4.6

[56] References Cited

U.S. PATENT DOCUMENTS

| | | | |
|---|---|---|---|
| 3,100,445 | 8/1963 | Poulter | 102/309 |
| 3,443,518 | 5/1969 | Cross | 102/306 |
| 3,561,361 | 2/1971 | Kessenich et al. | 102/307 |
| 3,658,007 | 4/1972 | Bucklisch | 102/306 |
| 3,736,875 | 6/1973 | Bucklisch | 102/309 |
| 4,250,792 | 2/1981 | Deigmuller et al. | 102/309 |
| 4,543,703 | 10/1985 | Wetzel et al. | 175/4.6 |
| 4,594,946 | 6/1986 | Ringel et al. | 102/309 |
| 4,658,900 | 4/1987 | Stout | 175/4.6 |
| 4,672,896 | 6/1987 | Precoul et al. | 102/309 |
| 4,711,181 | 12/1987 | Ringel et al. | 102/309 |

FOREIGN PATENT DOCUMENTS 0091860 10/1983 European Pat. Off. ..... 102/309

*Primary Examiner*—David H. Brown

*Attorney, Agent, or Firm*—Hubbard, Thurman, Turner & Tucker

[57] ABSTRACT

An improved shaped charge is provided for well perforating guns utilized in hydrocarbon recovery operations. An increased diameter entry hole through the casing may be formed by the shaped charge, which is particularly beneficial when perforating gravel packed formations. The explosive powder within the charge case is initiated utilizing a multi-point discharge insert which channels the shock waves from the primer cord of the gun to multiple points each radially spaced from the center line of the charge case. A plasticizer charge is utilized to fill the relatively small diameter channels formed by the insert, and an insert material having a relatively low speed of sound is preferred to prevent detonation of the explosive powder through the insert material. By changing the configuration and the size of the insert channels, the entry hole size and depth of penetration formed by the shaped charges of the gun may be easily and inexpensively modified.

1 Claim, 2 Drawing Sheets

SHAPED CHARGE HAVING MULTI-POINT INITIATION FOR WELL PERFORATING GUNS AND METHOD

FIELD OF THE INVENTION

The present invention relates to perforating guns having shaped charges utilized for subterranean oil and gas recovery operations and, more particularly, relates to improved shaped charges for such guns.

BACKGROUND OF THE INVENTION

Subterranean oil and gas wells are typically perforated utilizing a perforating gun suspended in the well from either a wireline or a tubing string. The gun may perforate either the formation of interest (for an uncased well), the casing and the formation (for a cased well).

Radially projecting shaped charges having a powder explosive have long been utilized in perforating guns to perform the actual perforation of the well. Prior art perforating charges are disclosed, for example, in U.S. Pat. Nos. 3,025,794 and 4,643,097. Such shaped charges are typical "set off" by primer cord, which in turn is activated by a booster charge. The booster charge may be fired by various techniques, such as by the impact of a go-devil dropped through the tubing string on a downwardly facing charge in the gun body.

The performance of a shaped charge is typically measured by the diameter and/or size of the entry hole (perforation) and the depth of penetration (total tip penetration) formed by the shaped charge. The particular subterranean environment in which the gun is utilized determines the desired performance of the shaped charge. In a gravel packed oil well, for instance, the total tip penetration is not particularly significant, although the size of the entry hole through the casing is very significant.

Those skilled in the art have long recognized that the positioning and spacing of the shaped charges in the perforating gun drastically affect the hydrocarbon recovery from the well. In certain formations, for example, shaped charges are spaced at 3" axial intervals along the gun body, while for other perforations a gun is utilized with shaped charges spirally spaced at 1" axial intervals to provide more perforations per foot through the casing.

Although various components of the shaped charge could theoretically be adjusted to alter the performance of the shaped charge, such components in practice are rarely changed due to safety, reliability, and cost considerations. The type and composition of the explosives used in the shaped charge are limited to obtain reliable yet safe operation of the perforating guns. The length and diameter of the charge case and thus the volume of explosive within the shaped charge are generally standardized to minimize manufacturing costs for gun bodies designed for positioning in certain diameter holes, e.g., within a 7⅝" diameter casing.

Prior art perforating guns with shaped charges thus provide limited flexibility for modifying the performance of the shaped charge. The disadvantages of the prior art are overcome by the present invention, and improved techniques are hereinafter disclosed for both increasing the efficiency of a shaped charge, and for easily and inexpensively modifying the performance of the shaped charge in a perforating gun.

SUMMARY OF THE INVENTION

The perforating gun of the present invention includes a booster charge for firing a primer cord, which is connected to multiple shaped charges in the gun. Each shaped charge typically has a central axis perpendicular to the axis of the gun, and thus the charge makes a generally horizontal perforation through a vertical casing in a well.

The shaped charge comprises a cup-shaped body or charge case having a generally parabolic rearward end with an aperture for positioning adjacent the primer cord. An insert of a selected material is positioned within the generally parabolic rearward end of the shaped charge, and forms a plurality of passageways each having one end adjacent the aperture and the other end radially spaced from the center line of the charge case. The exterior surface of the insert may be scalloped, so that the interior wall of the charge case cooperates with the insert to define at least a portion of each passageway.

An explosive with a plasticizer is preferably placed within the aperture of each charge case and the passageways formed by the insert. A conventional powder explosive is thereafter pressed between the planar face of the insert and a conventional conical metallic liner element.

The shock waves initiated by the primer cord travel through the passageways in the insert, and thus initiate the powder charge in a symmetrical and uniform manner at a plurality of points each spaced from the apex of the liner and the axis of the charge case. The material of the insert, e.g., zinc, is selected preferably having a low shock wave transmission speed, so that a significant mismatch occurs between the detonation speed of the plastic explosive adjacent the insert and within the passageways and shock waves travelling through the insert. This technique insures that detonation of the powdered explosive occurs only through the explosive material in the passageways, and not through the insert itself. By transmitting the energy away from the axis of the shaped charge, the efficiency of the shaped charge may be significantly increased.

Typically eight passageways may be defined by the insert and the interior wall of the charge case. In one embodiment, a terminal end of each of the passageways is substantially parallel with the axis of the charge case and perpendicular to a planar end of the insert. The diameter and geometric configuration of the passageways may be easily altered by changing inserts. Performance of the shaped charge can thus be easily and inexpensively modified.

These and further features and advantages of the present invention will become apparent from the following detailed description, wherein reference is made to the figures in the accompanying drawings.

DETAILED DESCRIPTION OF PREFERRED EMBODIMENTS

Figure 1:
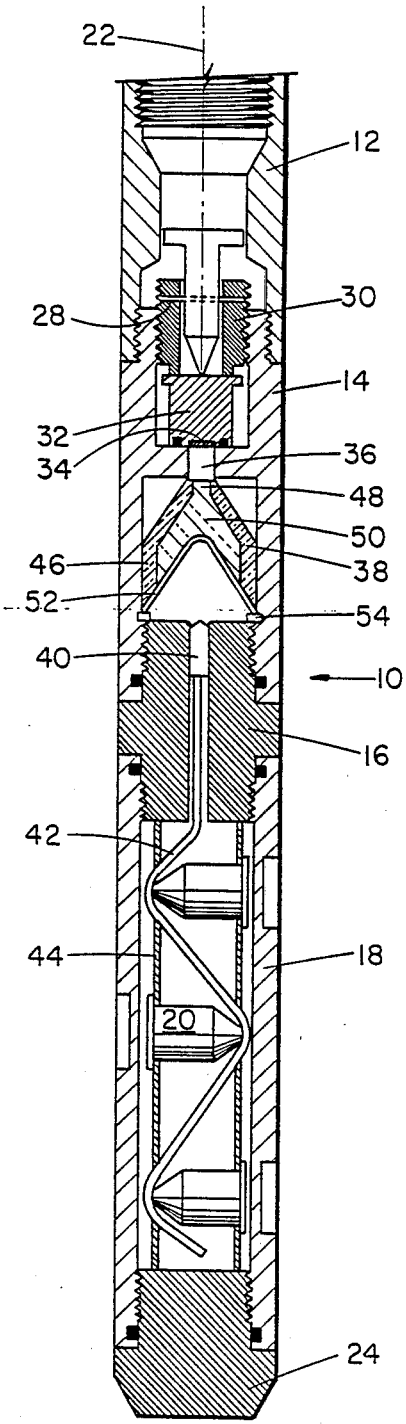
FIG. 1 is a simplified vertical view, partially in cross-section, of a suitable perforating gun incorporating the improved shaped charges of the present invention.

A perforating gun according to the present invention may be suspended in a subterranean oil or gas well from either a conventional wireline or a tubular string. The downhole gun may then be fired by various conventional techniques, including an electric charge passed down the wireline, activation of a downhole battery pack, or impact on a firing pin caused by either the dropping of a go-devil or a change in relative fluid pressure in the well bore. A suitable gun 10 according to the present invention as shown in FIG. 1 is of the type suspended from a tubular string and activated by dropping a go-devil through the tubing string.

The gun 10 can be suspended from sleeve 12 which in turn is connected to a tubing string (not shown). An upper housing 14 is threadably connected to sleeve 12, and connector 16 similarly joins the lower housing 18 to the upper housing in a conventional manner. A desired number of shaped charges 20 are positioned within the lower housing 18, each typically having an axis perpendicular to the central axis 22 of the gun. A conventional bull plug 24 maybe threadably connected to the lower housing. The outer diameter of the tubing string typically determines the outer diameter of the gun body, and accordingly the maximum length of the shaped charges 20 described subsequently. Each of the members 14, 16 and 18 therefore has a uniform outer diameter consistent with the diameter of the tubing string for positioning the gun within a well bore.

A go-devil (not shown) may be dropped through the tubing string for impacting firing pin 26, which is temporarily secured by shear pin 28 to mounting sleeve 30 as shown. Downward impact engagement of the firing pin 26 on the detonator assembly 32 initiates an explosive charge which penetrates thin metal disk 34 and passes downward through passageway 36 to activate the downwardly directed shaped charge 38. Activation of the shaped charge 38, in turn, fires conventional booster charge 40, which is connected to primer cord 42. Each of the shaped charges 20 is mounted on a charge carrier strip 44 for positioning the shaped charges in a conventional manner. Further details regarding the components of a suitable gun are disclosed in U.S. Pat. No. 4,658,900, hereby incorporated by reference. The gun of the present invention may alternatively may be of the type disclosed in U.S. Pat. Nos. 4,635,734 or 4,657,089. A carrier strip having a hexagonal cross-sectional configuration may be utilized for mounting the charges 20 of the present invention, as disclosed in U.S. Pat. No. 4,543,703.

The downwardly directed shaped charge 38 is not the subject of the present invention, but is generally illustrative of prior art shaped charges typically positioned within the housing 18. The shaped charge 38 comprises a cup-shaped body or charge case 46 having an aperture 48 at the apex of its conical rearward end. A suitable powdered explosive 50 is placed between the charge case and a metallic liner element 52 secured in place by retaining ring 54. Further details regarding prior art shaped charges are disclosed in U.S. Pat. No. 4,643,097, also hereby incorporated by reference.

Figure 2:
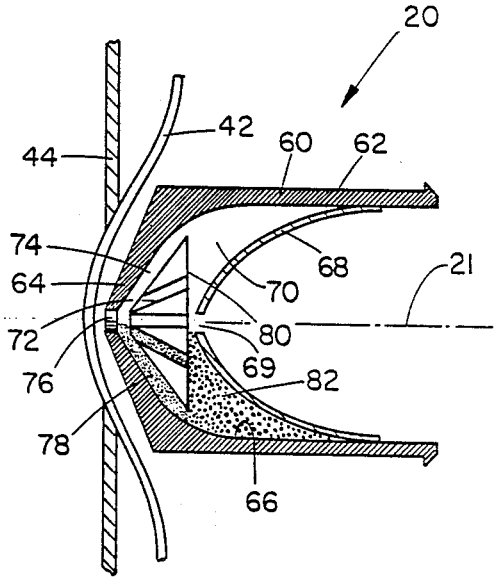
FIG. 2 is a vertical view, partially in cross-section, of a shaped charge according to the present invention mounted on a carrier strip of a gun.

Referring now to FIG. 2, a suitable shaped charge 20 is shown mounted on a conventional carrier strip 44. The shaped charge is fired or activated by primer cord 42 in a conventional manner to perforate the casing or formation of interest. The center line 21 of the shaped charge is thus perpendicular to the central axis of the gun, so that each of the shaped charges 20 fires within a relatively horizontal plane (assuming the gun is vertically positioned in the well).

The shaped charge 20 comprises a metallic cup-shaped body or charge case 60 having a cylindrical outer wall 62 and a rearward conical shaped end 64. The interior surface 66 of the body 60 has a "rounded conical" or parabolic configuration, and basically defines the "shape" of the shaped charge. A conventional thin metallic liner 68 having an axially aligned aperture 69 holds the charge within the cavity 70 formed by the interior wall 66, as explained subsequently.

The generally conically-shaped insert 72 is positioned within the body 60, with the apex of insert 72 adjacent aperture 76 and the apex of body 62, thereby placing the tip of insert 72 closely adjacent the primer cord 42. An explosive with a plasticizer 78 fills passageways 74 defined by the insert, and also fills aperture 76 adjacent the primer cord. The remainder of cavity 70 between surface 66 and liner 68 is filled with a conventional powder explosive 82. Planar base 80 of the insert 22 is thus perpendicular to the center line 21 of the shaped charge. It should be understood, of course, that the explosive material 78 and 82 is only shown in the lower portion of the shaped charge 20 shown in FIG. 2, while the passageways 74 and cavity 7 are shown in the upper portion of the shaped charge 20. In practice, all the passageways 74 and the entirety of the cavity 70 are filled with the explosive material.

Figure 3:
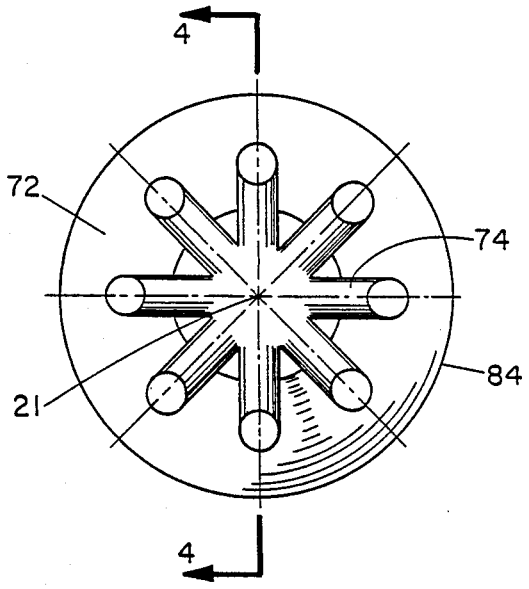
FIG. 3 is an end view of one embodiment of an insert for the shaped charge shown in FIG. 2.
Figure 4:
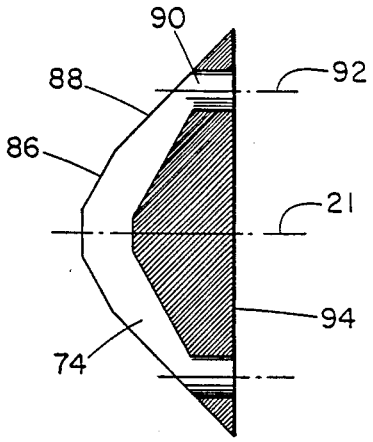
FIG. 4 is a cross-sectional view of the insert shown in FIG. 3.

Further details regarding the insert 72 shown in FIG. 2 are depicted in FIGS. 3 and 4. FIG. 3 is an end view of the insert directly facing the tip end of the insert, and FIG. 4 is a cross-section of the insert 72. The general configuration of the insert 72 is conical, and accordingly surfaces 86 and 88 are shaped to conform to their respective engaging surface 66 in the body. Eight passageways 74 are thus formed, each of which extends from the aperture 76 to a location substantially radially spaced from the axis 21 of the shaped charge. Any suitable number of passageway may be provided although preferably the passageways are each identical and are symmetrically arranged about the axis of the shaped charge. Also, the general configuration of the interior cavity defined by surface 66 of the body 60 is such that any plane perpendicular to the axis 21 of the shaped charge defines a generally circular pattern for the interior wall of the body, and accordingly any plane perpendicular to the axis of the insert 72 similarly defines a generally circular perimeter 84 of the insert.

The cross-sectional configuration of each passageway 74 could be of various designs, although for symmetry and ease of manufacturing, a generally circular cross-section of each passageway 74 is suitable, with the axis of each passageway generally parallel to the adjacent surface 66 of charge case 66. Each passageway 74 of insert 72 thus moves axially away from center line 21 and toward the planar base surface 94. A portion 90 of each passageway 74 adjacent surface 94 is perpendicular to surface 94, and is thus parallel with the central axis 21. Eight circular openings are thus symmetrically spaced about axis 21 as shown, with the axis 92 of each opening being parallel to central axis 21 and preferably spaced substantially from axis 21 and spaced substantially adjacent the circular edge 84.

Figure 5:
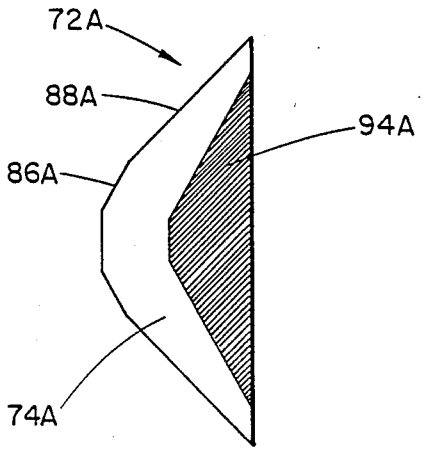
FIG. 5 is a cross-sectional view of another embodiment of an insert.

The insert 72A shown in FIG. 5 is similar to the insert described above, with surfaces 86A, 88A, and 94A being identical to the respective surfaces shown on FIG. 4. Passageways 74A continue to extend radially outwardly, however, to the surface 94A, so that the insert and the inner wall 66 define each passageway 74A. The outer configuration of the insert 72A is thus generally scalloped-shaped, with the cross-sectional configuration of each passageway 74A between the body of insert 72A and the interior surface 66 having a generally U-shaped configuration.

Referring again to FIG. 2, explosive 78 is preferably pressed into the restricted passageways of the insert and completely fills each passageway. The explosive 78 thus may be a plastic bonnet explosive which includes a Viton plasticizer as a bonding agent. A 9% Viton A dissolved in MEK and a 91% pure HMX powder provides a suitable explosive (approximately 450 thousand foot pounds output per pound) for filling the small passageways and also has sufficient bonding strength to hold it in place once it is cured. During assembly, the explosive 78 is homogeneously mixed and the mixture applied with a putty knife with the insert 72 in place against the body 60. Excess material is cleaned around the aperture 76 and planar surface 80, and the explosive is cured in a conventional manner, e.g., approximately 140° F. for 24 hours.

Thereafter, approximately 20 grams of a conventional dry shaped charge powder 82 is placed on top of the insert, and metal liner 68 then installed. Very high pressure, e.g., 30,000 psi, is applied to the liner to press the explosive 82 in place. This pressure is also sufficient to secure the perimeter of the liner 68 to the interior surface 66, as shown in FIG. 2.

The insert of the present invention takes the energy from the primer cord adjacent aperture 76 and transmits that energy symmetrically and uniformly about the apex of the liner 68. This technique thus provides multiple "points" of initiation of the powder charge 82 rather than a single initiation point. Also, these initiation points are symmetrically arranged about and spaced substantially from axis 21, thereby increasing the efficiency from the charge.

In order that the charge 82 is initiated as described above, however, the detonation of the charge must occur through the explosive in the passageways 74 and not through the material of the insert 72. The detonation speed of the explosive 78 described above is typically between 8,000 and 9,000 meters per second. The length of each of the passageways 74 is, of course, significantly longer than the axial path through the insert 72. Accordingly, it is preferred that the material of insert 72 have a relatively slow speed of shock wave transmission, preferably less than approximately 5,000 meters per second, so that a significant mismatch exists between the speed of detonation travelling through the passageways add the shock wave travelling through the insert material. Zinc has a relatively low speed of shock wave transmission, and has been determined to be a suitable material for the insert. Lead or an elastomeric (such as nylon) with glass beads may also be suitable materials. Preferably, the material of the insert will have a speed of shock wave transmission less then approximately 60% of the velocity of detonation of the powder in the passageways formed by the insert.

A significant feature of the present invention is that performance of the shaped charge can be easily and inexpensively altered by changing only the insert within the shaped charge. Thus, different types of shaped charges may be fabricated, each having the same explosives and same geometric size, but with different inserts. Inserts with different sized passageways may be provided, and the passageway geometry can be altered, as shown by FIGS. 4 and 5. The desired performance of a gun can thus be obtained by using the chosen shaped charge in the gun, and without altering the other components of a standard perforating gun. Thus the perforating hole size and depth of penetration for the gun can be easily selected depending on the particular characteristics of the formation or the environment in which the gun is used.

The performance of shaped charges according to the present invention may be compared with base data for a similar conventional 6 inch gravel packing charge, as shown by the following table. Insert 4 conforms to the geometry of FIG. 4, and insert 5 to the geometry of FIG. 5. The fractional number after the hyphen indicates the nominal diameter of each passageway formed by the insert, so that a 4-3/16 insert has nominal 3/16" diameter passageway and conforms to the geometry of FIG. 4. The tests results below were obtained from shaped charges each using an insert which defined eight passageways. The relative increase (plus) or decrease (minus) in entry hole diameter and total tip penetration is given compared to the base data for the conventional charge.

| Insert Type | Entry Hole Diameter | Total Tip Penetration |
|---|---|---|
| 4⅛ | +25% | −14% |
| 4 3/16 | +32% | −20% |
| 4¼ | +27% | −18% |
| 5⅛ | −9% | +2% |
| 5 3/16 | +6% | −11% |
| 5¼ | +5% | +8% |

The above data is particularly significant in view of the high repeatability of entry hole diameter and total tip penetration data for identical insert types. Although all of the factors affecting the performance of a shaped charge utilizing an insert according to the present invention are not fully understood, the repeatability of this test data strongly suggests that the desired shaped charge performance can be repeatably obtained through experimentation using different types of inserts. The multipoint initiation concept of the present invention thus allows for increased variance in the perforating gun performance by selecting shaped charges with an insert having preferred characteristics, particularly with respect to entry hole diameter and total tip penetration.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An improved shaped charge for use in a perforating gun of the type positionable in a subterranean well for perforating a selected formation, the shaped charge being activated by a primer cord in the perforating gun, the shaped charge comprising:

a cup-shaped charge body having an aperture at its rearward end aligned with an axis of the shaped charge and having a generally parabolic interior surface extending uniformly from the aperture to a front end of the charge body;

a generally conical-shaped insert housed within the charge body with its apex adjacent the aperture in the rearward end of the charge body, the insert at least partially defining each of a plurality of passageways each extending from the apex of the insert to a terminal point spaced substantially from the axis of the shaped charge;

a generally parabolic-shaped liner housed within the charge body having its apex generally aligned with the axis of the shaped charge and its perimeter portion adjacent the interior surface of the charge body, the linear and the interior surface of the charge body defining a cavity in the charge body;

a first explosive in each of the passageways formed by the insert for transmitting energy from the primer cord to multiple points spaced from the axis of the shaped charge;

said insert being formed form a selected material having a speed of shock wave transmission less than approximately 60% of the velocity of detonation of the first explosive;

said insert having a planar surface at the terminal point of each of said passageways perpendicular to the axis of said liner;

a second explosive in the cavity of the charge body and adjacent the terminal point of each passageway for initiation by the first explosive, such that the second explosive is initiated at multiple points each spaced from the axis of the shaped charge.

* * * * *